US009665067B2

(12) United States Patent
Stranczl et al.

(10) Patent No.: US 9,665,067 B2
(45) Date of Patent: May 30, 2017

(54) OPTIMISED ESCAPEMENT WITH SECURITY MEANS

(71) Applicant: Nivarox-FAR S.A., Le Locle (CH)

(72) Inventors: Marc Stranczl, Nyon (CH); Gianni Di Domenico, Neuchatel (CH); Pascal Winkler, Marin (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/106,946

(22) PCT Filed: Dec. 9, 2014

(86) PCT No.: PCT/EP2014/076958
§ 371 (c)(1),
(2) Date: Jun. 21, 2016

(87) PCT Pub. No.: WO2015/096975
PCT Pub. Date: Jul. 2, 2015

(65) Prior Publication Data

US 2016/0357149 A1 Dec. 8, 2016

(30) Foreign Application Priority Data

Dec. 23, 2013 (CH) ..... 2140/13
Dec. 23, 2013 (EP) ..... 13199427
(Continued)

(51) Int. Cl.
*G04B 15/08* (2006.01)
*G04B 15/12* (2006.01)
(Continued)

(52) U.S. Cl.
CPC ..... *G04B 15/08* (2013.01); *G04B 15/12* (2013.01); *G04B 15/14* (2013.01); *G04B 17/32* (2013.01); *G04C 5/005* (2013.01)

(58) Field of Classification Search
CPC ..... G04B 15/08; G04B 15/12; G04B 15/14; G04B 17/20; G04B 17/32; G04C 5/005
See application file for complete search history.

(56) References Cited

U.S. PATENT DOCUMENTS 2,669,089 A * 2/1954 Straumann ..... G04B 15/12 368/124
2,750,730 A * 6/1956 Kohlhagen ..... G04C 5/005 368/125
(Continued)

FOREIGN PATENT DOCUMENTS

| | | |
|---|---|---|
| CH | 510 285 | 3/1971 |
| DE | 19 35 486 U | 3/1966 |
| EP | 2 431 823 A1 | 3/2012 |

OTHER PUBLICATIONS

International Search Report Issued Mar. 10, 2016 in PCT/EP14/76958 filed Dec. 9, 2014.

*Primary Examiner* — Vit W Miska
(74) *Attorney, Agent, or Firm* — Oblon, McClelland, Maier & Neustadt, L.L.P.

(57) ABSTRACT

An escapement mechanism including a stop member including a first actuator cooperating with a resonator and a second actuator cooperating with an escape wheel set subjected to a drive torque lower than a nominal torque. The first actuator includes a magnetically or electrically charged pole piece, the resonator includes a magnetically or electrically charged track, and the pole piece and/or the track create, in an air gap between the pole piece and the track, a magnetic or electrostatic field having an intensity ensuring relative driving of the stop member and of the resonator when the torque is lower than the nominal torque. The stop member and/or the resonator include an arresting mechanism limiting relative movement between the actuator and the resonator when the torque is greater than the nominal torque.

14 Claims, 1 Drawing Sheet

(30) Foreign Application Priority Data

| | | |
|---|---|---|
| Jul. 11, 2014 | (CH) | 1057/14 |
| Jul. 11, 2014 | (EP) | 14176816 |
| Sep. 24, 2014 | (EP) | 14186262 |

(51) Int. Cl.

| | |
|---|---|
| ***G04B 17/32*** | (2006.01) |
| ***G04C 5/00*** | (2006.01) |
| ***G04B 15/14*** | (2006.01) |

(56) References Cited

U.S. PATENT DOCUMENTS

| | | | | |
|---|---|---|---|---|
| 3,183,426 | A | 5/1965 | Haydon et al. | |
| 3,630,018 | A | 12/1971 | Nicholas | |
| 3,652,955 | A | 3/1972 | Cruger et al. | |
| 3,673,792 | A * | 7/1972 | Scholz | G04B 11/00 368/127 |
| 2012/0269043 | A1 * | 10/2012 | Baudet | G04C 5/005 368/126 |

* cited by examiner 1
100
200
2
3
4
5

2
21
210
310
211
311
31
3
1
32
320
42
420
4

2
21
210
310
31
3
1
32
322
422
320
42
420
4

OPTIMISED ESCAPEMENT WITH SECURITY MEANS

CROSS-REFERENCE TO RELATED APPLICATIONS

This is a National Phase Application in the United States of International Patent Application PCT/EP2014/076958 filed Dec. 9, 2014 which claims priority on Swiss Patent Application No. 02140/13 of Dec. 23, 2013, European Patent Application No. 13199427.9 of Dec. 23, 2013, Swiss Patent Application No. 01057/14 of Jul. 11, 2014, European Patent Application No. 14176816.8 of Jul. 11, 2014, European Patent Application No. 14186262.3 of Sep. 24, 2014.

FIELD OF THE INVENTION

The invention concerns a timepiece escapement mechanism including a stop member between a resonator and an escape wheel set subjected to a drive torque lower than or equal to a nominal torque, said stop member comprising at least a first actuator arranged to cooperate with said resonator and at least a second actuator arranged to cooperate with said escape wheel set.

The invention also concerns a timepiece movement including at least one such escapement mechanism.

The invention also concerns a timepiece comprising at least one such movement.

The invention concerns the field of timepiece mechanisms for the transmission of motion, and more specifically the field of escapement mechanisms.

BACKGROUND OF THE INVENTION

An escapement mechanism wherein at least a part of the transmission is contactless is characterized by better efficiency than an entirely mechanical escapement.

However, it is sensitive to shocks and to excessive torque to which the escape wheel set may be subjected.

SUMMARY OF THE INVENTION

The present invention proposes to replace the mechanical contact force between a stop member and an escape wheel set with a contactless force of magnetic or electrostatic origin, by means of an arrangement which reliably and safely ensures the second function of releasing and locking the escape wheel in jerks, and which provides good protection against shocks and excessive torque.

To this end, the invention concerns a timepiece escapement mechanism including a stop member between a resonator and an escape wheel set subjected to a drive torque lower than or equal to a nominal torque, said stop member comprising at least a first actuator arranged to cooperate with said resonator and at least a second actuator arranged to cooperate with said escape wheel set, characterized in that said at least a first actuator comprises at least a first magnetically charged or ferromagnetic, or respectively electrically charged or electrostatically conductive pole piece, in that said resonator comprises at least a first magnetically charged or ferromagnetic, or respectively electrically charged or electrostatically conductive track, and at least said first pole piece and/or said first track creating a magnetic or electrostatic field in a first air gap between said at least a first pole piece and said first track, said first field having an intensity ensuring the relative driving of said stop member and of said resonator provided that the torque applied to said escape wheel set is lower than or equal to said nominal torque.

According to a feature of the invention, said stop member and/or said resonator comprises first arresting means for limiting the relative movement between said at least a first actuator and said resonator when the torque applied to said escape wheel set is greater than said nominal torque.

The invention also concerns a timepiece movement comprising at least one such escapement mechanism, comprising energy storage means cooperating with said escape wheel set.

The invention also concerns a timepiece, particularly a watch, including at least one such movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figures 1, 2, 3:
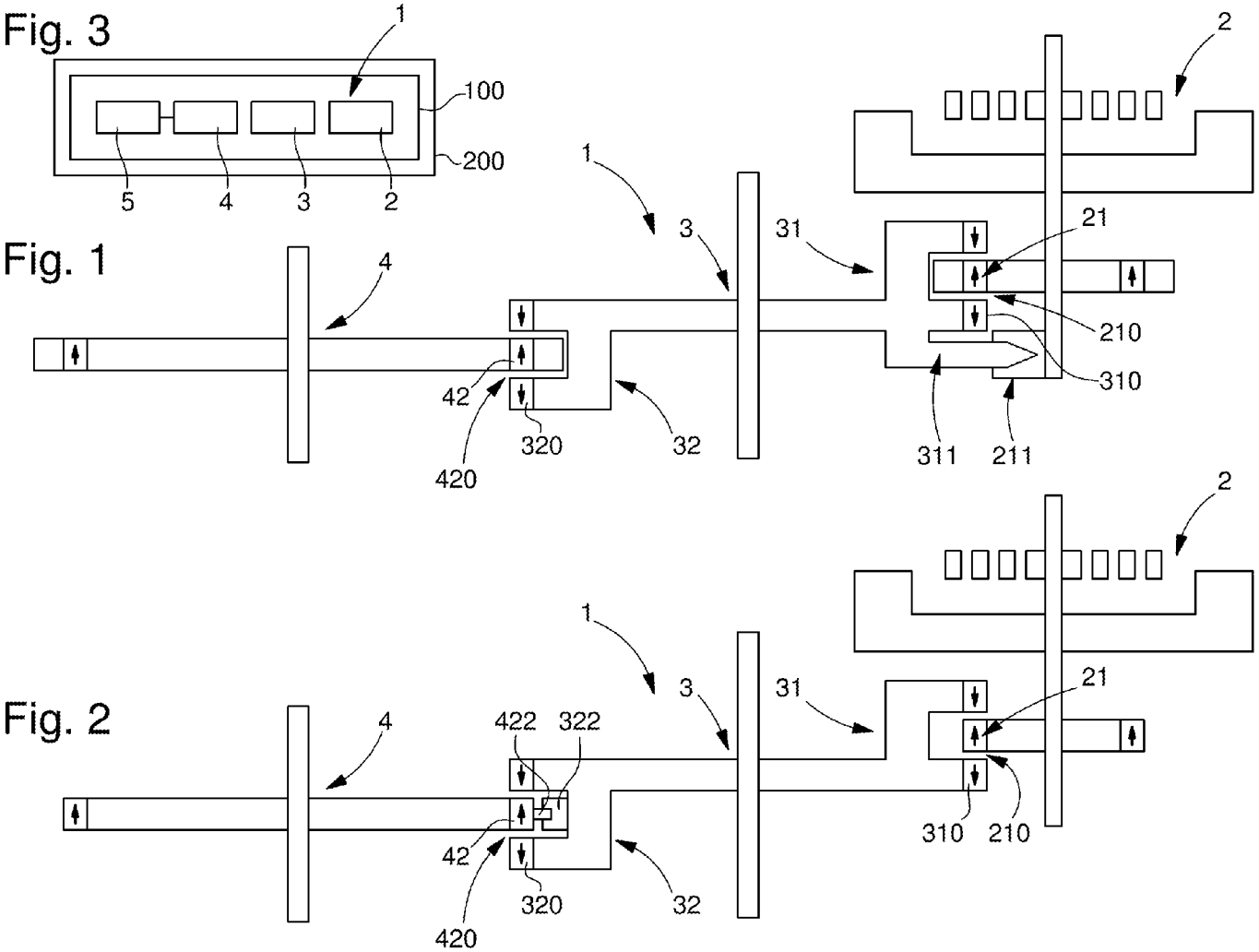
FIG. 1 shows a schematic cross-sectional view of an escapement mechanism according to the invention comprising arresting means at the interface between the resonator and the stop member.
FIG. 2 shows a schematic cross-sectional view of an escapement mechanism according to the invention comprising arresting means at the interface between the stop member and the escape wheel set.
FIG. 3 is a block diagram illustrating a timepiece comprising a movement incorporating an escapement mechanism according to the invention.

The invention proposes to replace the usual mechanical contact force between a resonator, notably a sprung balance, and a stop member, and between a stop member and an escape wheel set, notably an escape wheel, with a contactless force of magnetic or electrostatic origin.

The object is to improve the efficiency of the escapement, by transmitting force or torque using magnetic and/or electrostatic fields, and by maintaining all security features and operation in the event of high torque at the escape wheel. (The escapement does not become out of synchronization and does not block). Further, the magnetic or electrostatic escapement can, in many cases, have a constant force system.

The invention concerns a timepiece escapement mechanism 1 including a stop member 3 between a resonator 2 and an escape wheel set 4.

This escape wheel set is subjected to a drive torque lower than or equal to a nominal torque.

Stop member 3 comprising at least one first actuator 31, which is arranged to cooperate with resonator 2, and at least one second actuator 32, which is arranged to cooperate with escape wheel set 4.

According to the invention, the at least one first actuator 31 comprises at least a first magnetically charged or ferromagnetic, or respectively electrically charged or electrostatically conductive pole piece 310, and resonator 2 comprises at least one first magnetically charged or ferromagnetic, or respectively electrically charged or electrostatically conductive track 21.

At least the first pole piece 310 and/or the first track 21 creates a magnetic or electrostatic field in a first air gap 210 between the at least one first pole piece 310 and the first track 21. This first field has an intensity ensuring the relative driving of stop member 3 and of resonator 2 provided the torque applied to escape wheel set 4 is lower than or equal to the nominal torque.

In a particular embodiment, stop member 3 and/or resonator 2 comprises first arresting means 211 for limiting the relative movement between the at least one first actuator 31 and resonator 2 when the torque applied to escape wheel set 4 is greater than the nominal torque.

In a particular variant, these first arresting means 211, 311, comprise a magnetic or electrically charged barrier arranged to create a magnetic or electrostatic field higher than the first magnetic or electrostatic field beyond first air gap 210.

In a particular variant, these first arresting means 211, 311, comprise at least one mechanical stop member.

More specifically, the at least one second actuator 32 comprises at least a second magnetically charged or ferromagnetic, or respectively electrically charged or electrostatically conductive pole piece 320, and escape wheel set 4 comprises at least one second magnetically charged or ferromagnetic, or respectively electrically charged or electrostatically conductive track 42. At least the second pole piece 320 and/or the second track 42 creates a magnetic or electrostatic field in a second air gap 420 between the at least one second pole piece 320 and the second track 42. This second field has an intensity ensuring the relative driving of stop member 3 and of escape wheel set 4 provided the torque applied to escape wheel set 4 is lower than or equal to the nominal torque.

Stop member 3 and/or escape wheel set 4 comprises second arresting means 322; 422 for limiting the relative movement between the at least one second actuator 32 and escape wheel set 4 when the torque applied to escape wheel set 4 is greater than the nominal torque.

When both the at least one first actuator 31 and the at least one second actuator 32 are thus equipped for contactless transmission, resonator 2, stop member 3, escape wheel set 4, first arresting means 211, 311, and second arresting means 322, 422, together constitute an autonomous mechanical escapement replacing, when the torque is greater than the nominal torque, the contactless escapement formed by resonator 2, stop member 3, escape wheel set 4, first pole piece 310 and first track 21, second pole piece 320 and second track 42, which contactless escapement operates when the torque applied to escape wheel set 4 is lower than or equal to the nominal torque, and without allowing the mechanical banking cooperation between first arresting means 211, 311 and/or second arresting means 322, 422 and the opposing surfaces of resonator 2, or of stop member 3, or of escape wheel set 4.

More particularly, stop member 3 comprises first arresting means 311, formed here by a set of horns, and resonator 2 comprises first arresting means 211, formed here by a roller pin arranged to cooperate with this set of horns.

More particularly, the set of horns is supplemented by a guard pin, and the roller pin is supplemented by a roller notch arranged to cooperate with the guard pin.

In a particular embodiment, the guard pin is a magnetic or electrically charged guard pin.

More particularly, stop member 3 comprises second arresting means 322 formed by a set of pallet-stones, and escape wheel set 4 comprises second arresting means 422 formed by a toothing arranged to cooperate with the set of pallet-stones.

In particular embodiments, first track 21 includes a magnetized layer of variable thickness, or respectively, an electrically charged layer of variable thickness, or a magnetized layer of constant thickness but variable magnetization, or respectively, an electrically charged layer of constant thickness but variable electrical charge, or micro-magnets with variable surface density, or respectively, electrets with variable surface density, or a ferromagnetic layer of variable thickness, or respectively, an electrostatically conductive layer of variable thickness, or a ferromagnetic layer of variable shape, or respectively, an electrostatically conductive layer of variable shape, or a ferromagnetic layer wherein the surface density of holes is variable, or respectively, an electrostatically conductive layer wherein the surface density of holes is variable.

In particular embodiments, second track 42 includes a magnetized layer of variable thickness, or respectively, an electrically charged layer of variable thickness, or a magnetized layer of constant thickness but variable magnetization, or respectively, an electrically charged layer of constant thickness but variable electrical charge, or micro-magnets with variable surface density, or respectively, electrets with variable surface density, or a ferromagnetic layer of variable thickness, or respectively, an electrostatically conductive layer of variable thickness, or a ferromagnetic layer of variable shape, or respectively, an electrostatically conductive layer of variable shape, or a ferromagnetic layer wherein the surface density of holes is variable, or respectively, an electrostatically conductive layer wherein the surface density of holes is variable.

In a specific embodiment, stop member 3 is a pallet-lever.

The invention also concerns a timepiece movement 100 comprising at least one such escapement mechanism 1, comprising energy storage means 5 cooperating with escape wheel set 4.

The invention also concerns a timepiece 200, particularly a watch, including at least one such timepiece movement 100.

The Figures are simply an example, and for example, the escape wheel could be modified to have two levels and the pallet-lever to have only one level (except for the guard pin).

In short, the invention achieves two escapements in one.

These two escapements may be mechanical, magnetic, electrostatic or another type.

These two escapements are not in competition, but their operating ranges allow the second escapement to take over when the first departs from its acceptable torque range.

In the event of torque that is too high, the second escapement prevents loss of synchronization and does not block the system.

The "main", for example, magnetic escapement, enjoys improved efficiency since it operates without friction and is, for example a "constant force" escapement. It is also silent and has good chronometric properties. It may however present a problem as regards security and loss of synchronization in the event of a shock or excessive torque at the escape wheel set. The second complementary mechanical escapement, which is robust, but less efficient and struggles to provide a constant force, takes over when the torque is extreme for the first escapement. The two escapements combined are thus complementary and overall offer better properties.

The invention claimed is:

1. A timepiece escapement mechanism comprising:

a stop member between a resonator and an escape wheel set subjected to a drive torque lower than or equal to a substantially non-zero nominal torque, the stop member comprising at least a first actuator arranged to cooperate with the resonator and at least a second actuator arranged to cooperate with the escape wheel set, the at least one first actuator comprising at least a first magnetically charged or ferromagnetic, or respectively electrically charged or electrostatically conductive pole piece; and the resonator comprising at least one first magnetically charged or ferromagnetic, or respectively electrically charged or electrostatically conductive track, and at least the first pole piece and/or the first track creating a first magnetic or electrostatic field in a first air gap between the at least one first pole piece and the first track;

wherein the first field has an intensity ensuring relative driving of the stop member and of the resonator provided that the torque applied to the escape wheel set is lower than or equal to the nominal torque, wherein the stop member and/or the resonator comprises first arresting means for limiting relative movement between the first actuator and the resonator when the torque applied to the escape wheel set is greater than the nominal torque, and wherein the first arresting means comprises a magnetic or electrically charged barrier arranged to create a magnetic or electrostatic field higher than the first magnetic or electrostatic field beyond the first air gap.

2. The timepiece escapement according to claim 1, wherein the arresting means comprises at least one mechanical stop member.

3. The escapement mechanism according to claim 1, wherein the at least one second actuator comprises at least a second magnetically charged or ferromagnetic, or respectively electrically charged or electrostatically conductive pole piece, and wherein the escape wheel set comprises at least one second magnetically charged or ferromagnetic, or respectively electrically charged or electrostatically conductive track, and at least the second pole piece and/or the second track create a second magnetic or electrostatic field in a second air gap between the at least one second pole piece and the second track, the second field having an intensity ensuring relative driving of the stop member and of the escape wheel set provided torque applied to the escape wheel set is lower than or equal to the nominal torque, and wherein the stop member and/or the escape wheel set comprises second arresting means for limiting relative movement between the at least one second actuator and the escape wheel set when the torque applied to the escape wheel set is greater than the nominal torque.

4. The escapement mechanism according to claim 3, wherein the resonator, the stop member, the escape wheel set, the first pole piece and the first track, the second pole piece and the second track, together form a first contactless escapement mechanism arranged to operate when the torque applied to the escape wheel set is lower than or equal to the nominal torque, and without allowing mechanical banking cooperation between the first arresting means and/or the second arresting means and the opposing surfaces of the resonator, or of the stop member, or of the escape wheel set.

5. The escapement mechanism according to claim 3, wherein the resonator, the stop member, the escape wheel set, the first arresting means, and the second arresting means, together form a second mechanical escapement mechanism arranged to operate when the torque is greater than the nominal torque.

6. The escapement mechanism according to claim 4, wherein the resonator, the stop member, the escape wheel set, the first arresting means, and the second arresting means, together form a second mechanical escapement mechanism arranged to operate when the torque is greater than the nominal torque.

7. The escapement mechanism according to claim 1, wherein the stop member comprises first arresting means, formed by a set of horns, and wherein the resonator comprises first arresting means, formed by a roller pin arranged to cooperate with the set of horns.

8. The escapement mechanism according to claim 7, wherein the set of horns is supplemented by a guard pin, and the roller pin is supplemented by a roller notch arranged to cooperate with the guard pin.

9. The escapement mechanism according to claim 3, wherein the stop member comprises second arresting means, formed by a set of pallet-stones, and wherein the escape wheel set comprises second arresting means, formed by a toothing arranged to cooperate with the set of pallet-stones.

10. The escapement mechanism according to claim 1, wherein the first track includes a magnetized layer of variable thickness, or respectively, an electrically charged layer of variable thickness, or a magnetized layer of constant thickness but variable magnetization, or respectively, an electrically charged layer of constant thickness but variable electrical charge, or micro-magnets with variable surface density, or respectively, electrets with variable surface density, or a ferromagnetic layer of variable thickness, or respectively, an electrostatically conductive layer of variable thickness, or a ferromagnetic layer of variable shape, or respectively, an electrostatically conductive layer of variable shape, or a ferromagnetic layer wherein the surface density of holes is variable, or respectively, an electrostatically conductive layer wherein the surface density of holes is variable.

11. The escapement mechanism according to claim 3, wherein the second track includes a magnetized layer of variable thickness, or respectively, an electrically charged layer of variable thickness, or a magnetized layer of constant thickness but variable magnetization, or respectively, an electrically charged layer of constant thickness but variable electrical charge, or micro-magnets with variable surface density, or respectively, electrets with variable surface density, or a ferromagnetic layer of variable thickness, or respectively, an electrostatically conductive layer of variable thickness, or a ferromagnetic layer of variable shape, or respectively, an electrostatically conductive layer of variable shape, or a ferromagnetic layer wherein the surface density of holes is variable, or respectively, an electrostatically conductive layer wherein the surface density of holes is variable.

12. The escapement mechanism according to claim 1, wherein the stop member is a pallet-lever.

13. A timepiece movement comprising at least one escapement mechanism according to claim 1.

14. A timepiece comprising at least one timepiece movement according to claim 13.

* * * * *